US008715466B1

(12) United States Patent
Caouette

(10) Patent No.: US 8,715,466 B1
(45) Date of Patent: May 6, 2014

(54) METHOD AND SYSTEM FOR REDUCING WATER LOSS IN A PAPER MILL

(71) Applicant: Theodore Caouette, Stark, NH (US)

(72) Inventor: Theodore Caouette, Stark, NH (US)

( * ) Notice: Subject to any disclaimer, the term of this patent is extended or adjusted under 35 U.S.C. 154(b) by 0 days.

(21) Appl. No.: 13/655,946

(22) Filed: Oct. 19, 2012

(51) Int. Cl.
*D21F 1/66* (2006.01)

(52) U.S. Cl.
USPC ..... 162/190

(58) Field of Classification Search
USPC ..... 162/190, 198, 264, 335, DIG. 8; 210/928, 938, 710, 712
See application file for complete search history.

(56) References Cited

U.S. PATENT DOCUMENTS 5,378,322 A * 1/1995 Hornsey ..... 162/158
5,417,809 A 5/1995 Hoffman et al.
5,505,819 A * 4/1996 De Witt et al. ..... 162/142
5,558,782 A 9/1996 Bleakley et al.
5,567,278 A 10/1996 Meinander
5,958,189 A * 9/1999 Begemann et al. ..... 162/264
5,968,317 A 10/1999 Gartz et al.
6,071,380 A 6/2000 Hoffman
6,190,504 B1 2/2001 Karlsson et al.
6,368,461 B1 * 4/2002 Ruf et al. ..... 162/258
6,471,827 B2 * 10/2002 Lumiala et al. ..... 162/198
6,497,788 B1 12/2002 Prechtel et al.
6,514,379 B1 2/2003 Gartz et al.
6,585,860 B2 * 7/2003 Ruf et al. ..... 162/198
2002/0060016 A1 * 5/2002 Lumiala et al. ..... 162/190
2002/0060026 A1 * 5/2002 Huovila et al. ..... 162/258
2005/0173087 A1 8/2005 Hietaniemi
2007/0117140 A1 * 5/2007 Iizumi et al. ..... 435/6
2007/0258316 A1 * 11/2007 Matula ..... 366/160.1
2008/0230194 A1 * 9/2008 Matula ..... 162/166
2009/0114353 A1 * 5/2009 Tachikawa et al. ..... 162/29
2010/0227332 A1 * 9/2010 Iizumi et al. ..... 435/6
2011/0226432 A1 * 9/2011 Matula ..... 162/164.3

OTHER PUBLICATIONS

Handbook for Pulp and Paper Technologies, Process Control, Chapter 24), Gary A. Smook, 1992.*

* cited by examiner

*Primary Examiner* — Mark Halpern
(74) *Attorney, Agent, or Firm* — Lambert & Associates; Gary E. Lambert; David J. Connaughton, Jr.

(57) ABSTRACT

A method and system for reducing waste water from a paper machine system. The system involves splitting a flow output from a seal water tank. With a portion of the flow output being used to maintain a fluid level within a wire pit, and the balance being recycled to the system as substantially clean water.

8 Claims, 2 Drawing Sheets

METHOD AND SYSTEM FOR REDUCING WATER LOSS IN A PAPER MILL

BACKGROUND OF THE INVENTION

1. Field of the Invention

The present invention relates generally to process optimization. More particularly the present invention relates to a system to reduce water loss and overflow loss in a paper mill by recycling water back into the system, and using the entire overflow.

2. Description of Related Art

In present-day paper mills, an abundance of fresh water is needed for the paper making process, including, among other things, washing requirements and paper stock preparation. After these uses, these waters are passed mainly to mix with fibrous circulation waters. Any excess amount of circulation water is disposed of as waste water. The net amount of fresh water that is needed for a paper machine is of an order of about 10 cubic meters per ton of paper produced. Thus, from a paper mill, an abundance of warm waste water is obtained, which must be cleaned and filtered before disposal.

Therefore, what is needed is a system that may efficiently and effectively recycle water in a paper mill, reducing waste water and the need for fresh water.

SUMMARY OF THE INVENTION

The subject matter of this application may involve, in some cases, interrelated products, alternative solutions to a particular problem, and/or a plurality of different uses of a single system or article.

In one aspect, a method of conserving fluid in a paper machine system, such as a Fourdrinier machine system, is provided. The method eliminates overflow from a wire pit, and recycles excess water, minimizing waste. The method may begin with collecting a fluid drained from a paper stock on a wire mesh in a seal water tank. A quantity of this collected fluid may then be drained. The flow of the drained fluid is separated into two distinct flows, preferably through a splitting of piping through which the fluid travels. The first flow is directed to a wire pit of the paper machine system, the second flow is recycled to various processes requiring clean water in the paper machine system. Control of the first and second flows is determined largely based on a fluid level in the wire pit. A fluid level sensor is positioned to measure fluid level in the wire pit. This fluid level sensor is in electronic communication with a computer, and provides an output signal to the computer based on the fluid level measured. The computer is configured to adjust the fluid flow from the seal water tank to the wire pit to maintain the fluid level therein at a desired level. Adjustment may be performed by the computer adjusting one or a plurality of valves along the flows, and/or by adjusting a pump to control fluid flow rate. The balance of the fluid from the seal water tank passes to the second flow and is recycled. As such, the system efficiently recycles clean fluid through the system. Further, the need for processing waste water is eliminated because the system does not dispose of excess fluid.

In another aspect, a system of conserving fluid in a paper machine system is provided. This system prevents overflow from a wire pit to conserve and recycle fluid within the system. A wire mesh of the paper machine has a quantity of paper stock disposed on its top surface, and a quantity of fluid is allowed to drain from the paper stock, through the mesh to a seal water tank. This fluid may drain naturally by gravity, or may be urged out using a vacuum system. Fluid draining to the seal water tank is relatively distant from a head box where the paper stock is initially disposed on the wire mesh. As such, fluid draining from the stock is substantially clean, and contains almost no paper fibers. A piping is connected to the seal water tank, and drains the fluid from the tank. This piping splits into a first flow section and a second flow section. The first flow section directing fluid to a wire pit, the second flow section directing fluid to a clear water tank to be recycled into the paper machine system. A computer controller is configured to control fluid flows within the system. A fluid level sensor is positioned and configured to measure a level of fluid within the wire pit, and is in electronic communication with the computer controller. A valve is positioned along the piping, and may be positioned at any portion, for example, close to the seal water tank drain before the piping splits, on the first flow section, or on the second flow section. The valve is configured to control a fluid flow within the piping, and comprises an actuator in communication with the computer controller. This communication may be electronic, or pneumatic, or a combination of the two. The fluid level sensor is configured to send a first signal to the computer controller based on the fluid level measured. Based on the signal received, the computer controller is configured to send a second signal to the valve based on the first signal. In one embodiment, the valve may comprise an actuator which may receive the second signal and adjust the valve accordingly to increase or decrease flow through the valve. In a further embodiment, a plurality of valves and/or pumps may be positioned along the piping. The computer controller may be further configured to control one or multiple of these valves and/or pumps based on the signal received from the fluid level sensor.

In yet another aspect, a method of installing a system of conserving fluid on an existing paper machine system, such as a Fourdrinier machine, is provided. The method may be carried out on an existing machine system with minimal downtime of the system. Traditionally, a piping connects a seal water tank and a wire pit, with fluid flowing unimpeded from the seal water tank to the wire pit. The method begins with installing a quantity of new piping is to direct a portion of fluid flow in the existing piping to a clear water tank. The clear water tank acting as a storage area for fluid to be recycled into the system such as for stock preparation, shower systems, and the like. A valve is installed along either the existing piping or the new piping, the valve being configured to control a fluid flow through it. A fluid level sensor must be installed on the wire pit, to measure a fluid level therein. A computer controller may be installed, in communication with the fluid level sensor and the valve. The computer controller being configured to receive a first signal from the fluid level sensor, and to output a second signal to the valve based on the first signal. The valve is then configured to automatically adjust fluid flow through it based on the second signal. This automatic adjustment of the valve may be affected by, for example, an actuator. By controlling fluid level within the wire pit, the wire pit overflow can be eliminated.

DETAILED DESCRIPTION

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

The present invention utilizes a system and method that may be installed in existing paper machines. The present invention eliminates wire pit overflow, controls wire pit level, and allows relatively clean seal pit water to be recycled throughout the system for various uses.

Figure 1:
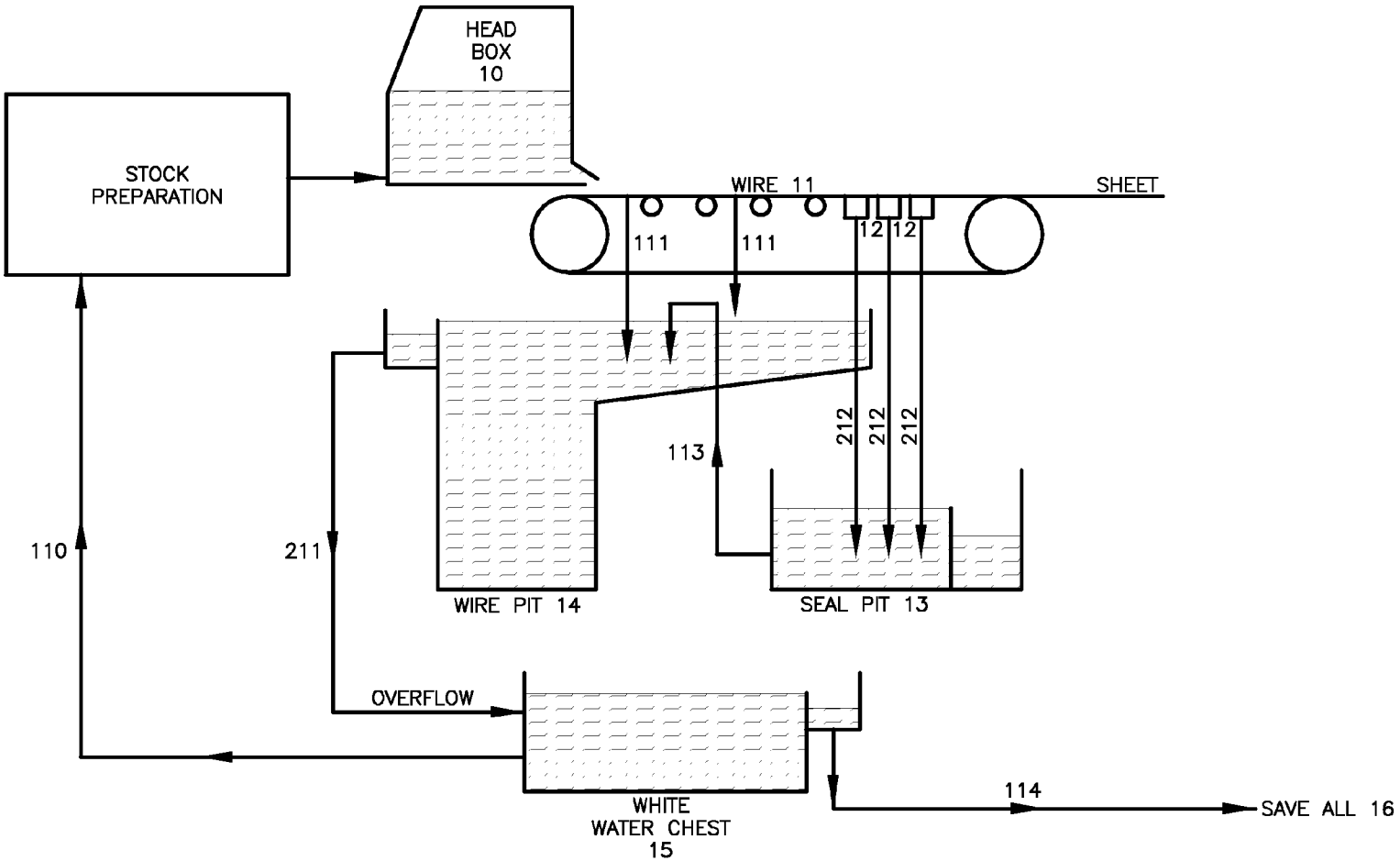
PRIOR ART FIG. 1
FIG. 1 provides a process view of a prior art paper machine system.

An example of a prior art paper mill wet end is shown in FIG. 1. In the prior art, paper stock exits the head box 10 and onto a wire 11. Along the wire, fluid drains from the solid fibrous content of the paper stock. Fluid 111 draining from a region close to the head box 10 contains a relatively high concentration of fibers, as well as chemicals, dyes and other contaminants. This fluid 111 drains to a wire pit 14. Fluid 211 from the wire pit 14 may overflow into a white water chest 15. The white water chest 15 fluid 211 may then be recycled for stock preparation 110. Excess fluid 211 in the white water chest is sent via 114 to a treatment (Save All) system 16. Through the treatment system 16 a substantial amount of fluid must be processed and sent to a sewer system, leading to wasted energy and fluid. This fluid could be recycled and reused, resulting in reduced cost and reduced waste.

Fluid 212 draining from a region further from the head box is pulled from a dryer stock and drains to a seal pit 13. This fluid may be drained by gravity, or may be urged from the stock using a vacuum system 12. This fluid 212 has a substantially lower concentration of fiber than fluid 111 draining from a region close to the head box.

Fluid from the seal pit drains freely via path 113 to the wire pit 14, causing the wire pit 14 to overflow. As discussed above, the overflow fluid 211 is transferred to a white water chest 15 for recycling and processing.

Figure 2:
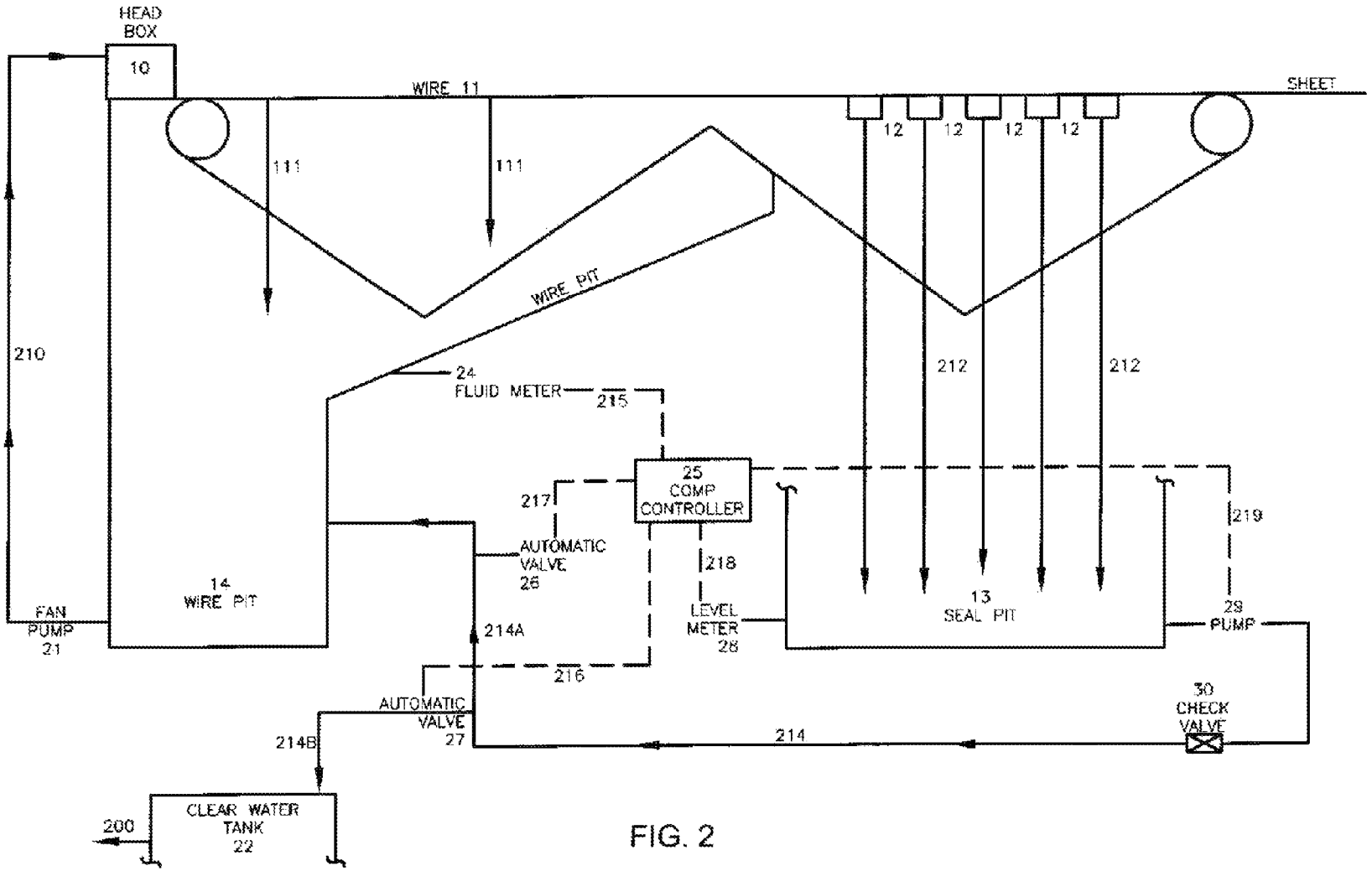
FIG. 2 provides a process view of the present invention.

By contrast, as shown in FIG. 2, the present invention prevents overflow from the wire pit 14, which contains cloudy white water, to the white water chest 15 of FIG. 1, eliminating the need for the white water chest 15 (of FIG. 1) entirely. Thereby eliminating the fluid flow path 211 of FIG. 1. Accordingly this clean seal pit 13 fluid 212 of FIG. 1 may be used for numerous uses in the plant aside from stock preparation in the head box. As shown in FIG. 2, seal pit 13 fluid of the present invention is used differently than the prior art.

FIG. 2 provides a process view of the present invention. Similarly to FIG. 1, a stock exits the head box 10 and is received on the wire 11. In a region close to the head box 10 fluid 111 drains from the wire 11 to a wire pit 14. Fluid 111 draining into the wire pit 14 may be recycled back to the head box 10 via path 210. In one embodiment, a fan pump 21 may be used to pump the fluid 111 along path 210 to the head box 10. Fluid 111 has a high concentration of fibers and other contaminants and is referred to herein as cloudy white water. In a region further from the head box, gravity, flat boxes or vacuum systems 12 serve to extract fluid 212 from the stock, which drains to the seal water tank 13. This fluid 212 has a substantially lower concentration of fiber and contaminants than the cloudy white water 111. Because of the low concentration, the fluid 212 is relatively pure and is referred to herein as clean water 212.

The clean water 212 from the seal water tank 13 may be drained from the tank along path 214. In one embodiment a pump 29 may aid in draining fluid 212 from the seal water tank 13. Further, a check valve 30 may prevent a backflow of fluid into the seal water tank. This path may then be split into two flows: 214*a* and 214*b*. Flow 214*a* may be recycled to the wire pit 14 to maintain fluid level therein. Flow 214*b* travels to a clear water tank 22. Fluid from the clear water tank 22 may exit the tank via 200 for use in stock prep, for shower water, and for other plant uses that require clean water 212.

Clean water 212 flow 214 from the seal water tank may be separated into flows 214*a* and 214*b* in any manner capable of separating flows in a controlled manner. In one embodiment, a three way valve (not shown) may be utilized to control flow separation from path 214 to 214*a* and 214*b*. In another embodiment, a valve 26 along path 214*a* may control flows along both 214*a* and 214*b*. In yet another embodiment, a valve 27 along path 214*b* may control flows along both 214*a* and 214*b*. In still another embodiment, two valves 26 and 27 may be used to control flow, 214*a* being controlled by valve 26, and 214*b* being controlled by valve 27.

A computer controller 25 may be utilized to control fluid flow along path 214, 214*a* to the wire pit 14 and/or 214*b* to the clear water tank 22. The computer controller may receive an input 215 from a fluid meter 24 which measures the level of fluid in the wire pit 14. Based on this input, the computer controller 25 may adjust flow valves 26 and/or 27 via electronic or pneumatic communication along paths 216 and 217. The computer controller 25 may also adjust pump 29 in other embodiments via electronic or pneumatic communication along path 219. In further embodiments, a liquid level meter 28 may communicate with the computer controller via electronic or pneumatic path 218. Based on this communication, the computer controller may adjust pump 29 via electronic or pneumatic path 219.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A method of conserving fluid in a paper machine system comprising the steps of:

collecting, in a seal water tank, a fluid drained from a paper stock disposed on a wire of a wet end section of the paper machine, the fluid containing substantially no fibers from the paper stock;

draining a quantity of the fluid from the seal water tank through a piping, the piping separating the quantity of the fluid drained into a wire pit flow and a recycling flow;

directing the wire pit flow to a wire pit;

eliminating a loss of a quantity of the fluid from the paper stock disposed on the wire of the wet end draining into a sewer by recycling the recycling flow into a process of the paper making system;

measuring a level of fluid in the wire pit using a sensor, the sensor providing an output to a computer;

positioning a first valve along the wire pit flow path, the first valve configured to control a fluid flow within the wire pit flow path, a first actuator of the first valve being in electronic communication with the computer;

positioning a second valve along the recycling flow path, the second valve configured to control a fluid flow within the recycling flow path, a second actuator of the second valve being in electronic communication with the computer;

eliminating an overflow of the wire pit by adjusting, using the computer, the wire pit flow to maintain the level of the fluid in the wire pit;

wherein the step of adjusting, using the computer, the wire pit flow comprises the steps of:

sending a first signal to the computer based on the level of fluid measured in the wire pit;

sending a second signal to the first actuator of the first valve based on the first signal, the second signal triggering the first actuator to adjust the first valve; and recycling the recycling flow into a process of the paper machine system thereby significantly decreasing introduction of a fresh quantity of water to the paper machine system.

2. The method of conserving fluid in a paper machine system of claim 1 wherein the step of adjusting, using the computer, the wire pit flow comprises the step of:

sending a signal using the computer to a pump positioned along the flow path from the seal water tank;

adjusting the pump automatically, based on the signal, to adjust the wire pit flow.

3. The method of conserving fluid in a paper machine system of claim 1 further comprising the step of recycling a quantity of wire pit fluid to a head box.

4. The method of conserving fluid in a paper machine system of claim 1 wherein the step of adjusting, using the computer, the wire pit flow comprises the step of:

sending a first signal using the computer to a first actuator of a first valve positioned along the wire pit flow path;

sending a second signal using the computer to a second actuator of a second valve positioned along the recycling flow path;

adjusting the first valve automatically by the first actuator, based on the first signal;

adjusting the second valve automatically by the second actuator, based on the second signal.

5. The method of conserving fluid in a paper machine system of claim 1 wherein the step of recycling the recycling flow into a process of the paper machine system comprises utilizing the recycling flow for a paper stock preparation.

6. The method of conserving fluid in a paper machines system of claim 1 wherein the step of recycling the recycling flow into a process of the paper machine system comprises utilizing the recycling flow for a wire shower system.

7. The method of conserving fluid in a paper machine system of claim 1 wherein the step of recycling the recycling flow into a process of the paper machine system comprises utilizing the recycling flow without processing of the fluid of the recycling flow.

8. The method of conserving fluid in a paper machine system of claim 1 wherein the step of adjusting, using the computer, the wire pit flow comprises the step of:

sending a signal using the computer to an actuator of a valve positioned where the fluid is separated into the wire pit flow and the recycling flow, the valve being a three-way valve;

adjusting the valve automatically by the actuator, based on the signal, to adjust the wire pit flow and the recycle flow.

* * * * *